United States Patent [19]

Wilms

[11] 4,132,915

[45] Jan. 2, 1979

[54] SPARK GAP PROTECTOR

[75] Inventor: Manfred W. Wilms, Goleta, Calif.

[73] Assignee: Joslyn Mfg. and Supply Co., Chicago, Ill.

[21] Appl. No.: 759,532

[22] Filed: Jan. 14, 1977

[51] Int. Cl.[2] ..... H01J 17/00; H01J 21/00

[52] U.S. Cl. ..... 313/325; 313/231.1; 315/36; 361/120; 361/124

[58] Field of Search ..... 361/124, 125, 120, 136; 313/231.1, 325; 315/36

[56] References Cited

U.S. PATENT DOCUMENTS

| | | | |
|---|---|---|---|
| Re. 29,391 | 8/1977 | Kawiecki | 361/124 |
| 3,755,715 | 8/1973 | Klayum et al. | 361/124 |
| 4,002,952 | 1/1977 | Menninga | 361/124 |
| 4,015,228 | 3/1977 | Eda et al. | 361/124 |

*Primary Examiner*—Saxfield Chatmon, Jr.

*Attorney, Agent, or Firm*—Klarquist, Sparkman, Campbell, Leigh, Hall & Whinston

[57] ABSTRACT

A spark gap protector includes a gas tube spark gap device received in a supporting base. A failsafe device for permanently shorting the spark gap protector to ground after an extended discharge includes a spring biased cage and a solder pellet. An extended surge current fuses the solder pellet resulting in movement of the shorting cage to a failsafe, shorted condition. The cage normally grasps a conducting ring spaced from a shorting contact member by a thin insulating spacer defining an auxiliary gap thereacross. In case the spark gap device vents so as to become substantially inoperative, and the cage does not operate to short the device, the auxiliary gap provided backup protection at a breakdown voltage somewhat greater than ordinarily supplied by the gas tube spark gap device.

16 Claims, 13 Drawing Figures

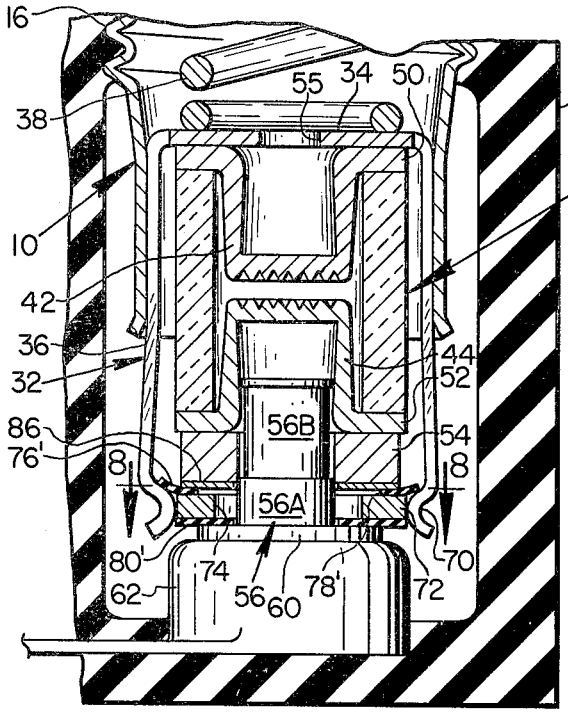
FIG. 6
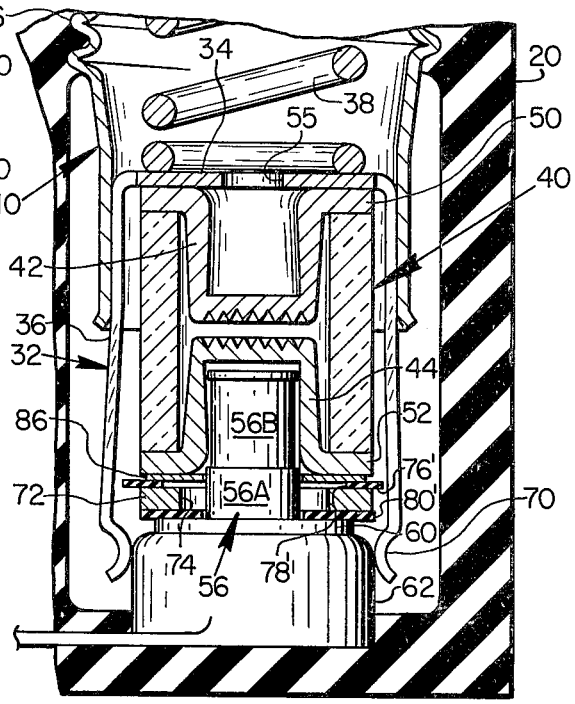
FIG. 7
FIG. 8
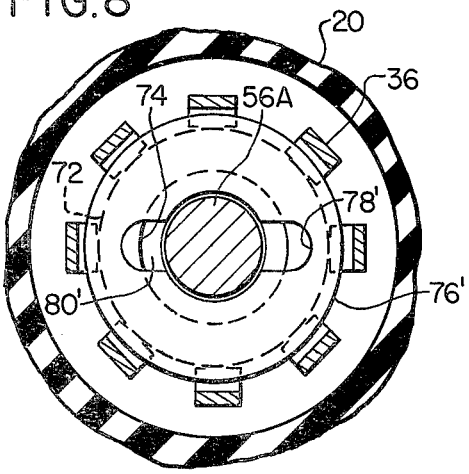
FIG. 9
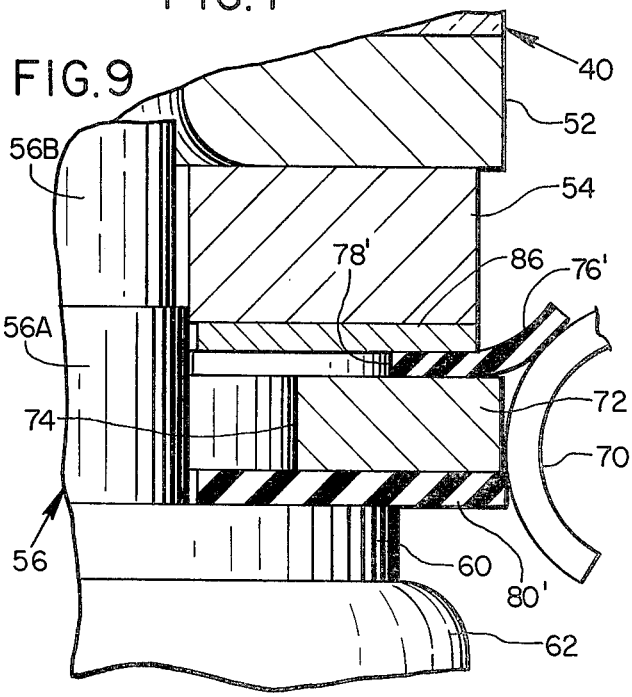

SPARK GAP PROTECTOR

BACKGROUND OF THE INVENTION

The present invention relates to spark gap protectors and more particularly to spark gap protectors providing backup protection in case of failure of a main spark gap.

Electrical communications equipment is conventionally provided with a station protector for shorting hazardous overvoltage surges to ground. These overvoltage surges can be caused by lightning strokes, power contact of the communication lines with voltage supply lines, power induction, ground potential rise and static buildup. The station protector typically includes a spark gap having carbon block electrodes disposed between the equipment line and ground, and a heat actuated "failsafe" means for permanently shorting the line to ground after an extended gap discharge renders the gap ineffective for further protection.

Another form of station protector includes a gas tube spark gap device and a permanent shorting means. This gas tube is advantageously employed since it can be designed to spark over at a comparatively low voltage as compared with carbon blocks, thereby offering additional protection. However, the gas tube device can become damaged as the result of an overvoltage condition, while insufficient heat is generated to actuate the "failsafe" permanent shorting means. For example, the normal gas tube spark gap device has a predetermined breakdown voltage, e.g., of a few hundred volts, but if the hermetic seal of the gas tube is broken as the result of a transient overvoltage condition, the breakdown voltage thereof may rise to several thousand volts providing insufficient protection to the line to which the device is connected. The gas tube device is dependent upon its internal gaseous environment for its low breakdown voltage, its electrodes being comparatively widely spaced for enhancing the operating life of the device and for enabling manufacture of the device at a lower cost than would be occasioned if a closer exact spacing had to be maintained.

SUMMARY OF THE INVENTION

According to the present invention, a spark gap protector includes a gas tube spark gap device and supporting means therefor providing contact for terminals of the gas tube spark gap device. The advantage of the gas tube spark gap device is its controllable, low voltage breakdown characteristics during regular operation which affords optimum, predictable protection to the line equipment. Shorting means activated by heat brings about shorting of the gas tube spark gap device under predetermined discharge conditions, i.e., as the result of passage of an appreciable current for a relatively extended time period. The protector is further provided with an insulating spacer, normally interrupting the circuit path of the shorting means, and defining thereacross an auxiliary gap having a breakdown voltage greater than the normal breakdown voltage of the gas tube spark gap device, but considerably below the breakdown voltage of the gas tube spark gap device electrodes without the intervening gaseous atmosphere. Thus, if the gas tube spark gap device fails to operate, and the normal shorting means has not operated, the auxiliary gap will break down and the surge will be shunted to ground.

It is accordingly an object of the present invention to provide an improved spark gap protector having the advantages of predictable, low voltage breakdown under ordinary conditions, failsafe shorting properties when an extended current discharge takes place, and backup protection in the event partial equipment damage.

It is another object of the present invention to provide an improved spark gap protector including a gas tube spark gap device and a shorting means activated by heat for bringing about shorting of the spark gap device under predetermined discharge conditions, having further auxiliary spark gap protection, normally interrupting the circuit path of the shorting means, for providing backup protection in the event of an inoperable gas tube spark gap device.

It is a further object of the present invention to provide an improved spark gap protector, including a gas tube spark gap device and heat activated shorting means therefor, with an auxiliary gap associated with the shorting means and normally interrupting the circuit path thereof which breaks down into a discharge under predetermined voltage conditions in the event of venting of the gas tube spark gap device.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 6 is an end view, partially broken away and in cross-section of a protector according to a third embodiment of the present invention;

FIG. 7 is another end view, partially broken away in cross-section, of a portion of the spark gap protector according to the third embodiment showing the relationship of elements in the absence of the fusible metal body normally incorporated in the device;

FIG. 8 is a transverse cross-section taken at 8—8 in FIG. 6;

FIG. 9 is a more detailed end view, partially broken away in cross-section, of a portion of the same spark gap protector illustrated in FIG. 6;

DETAILED DESCRIPTION

Figure 1:
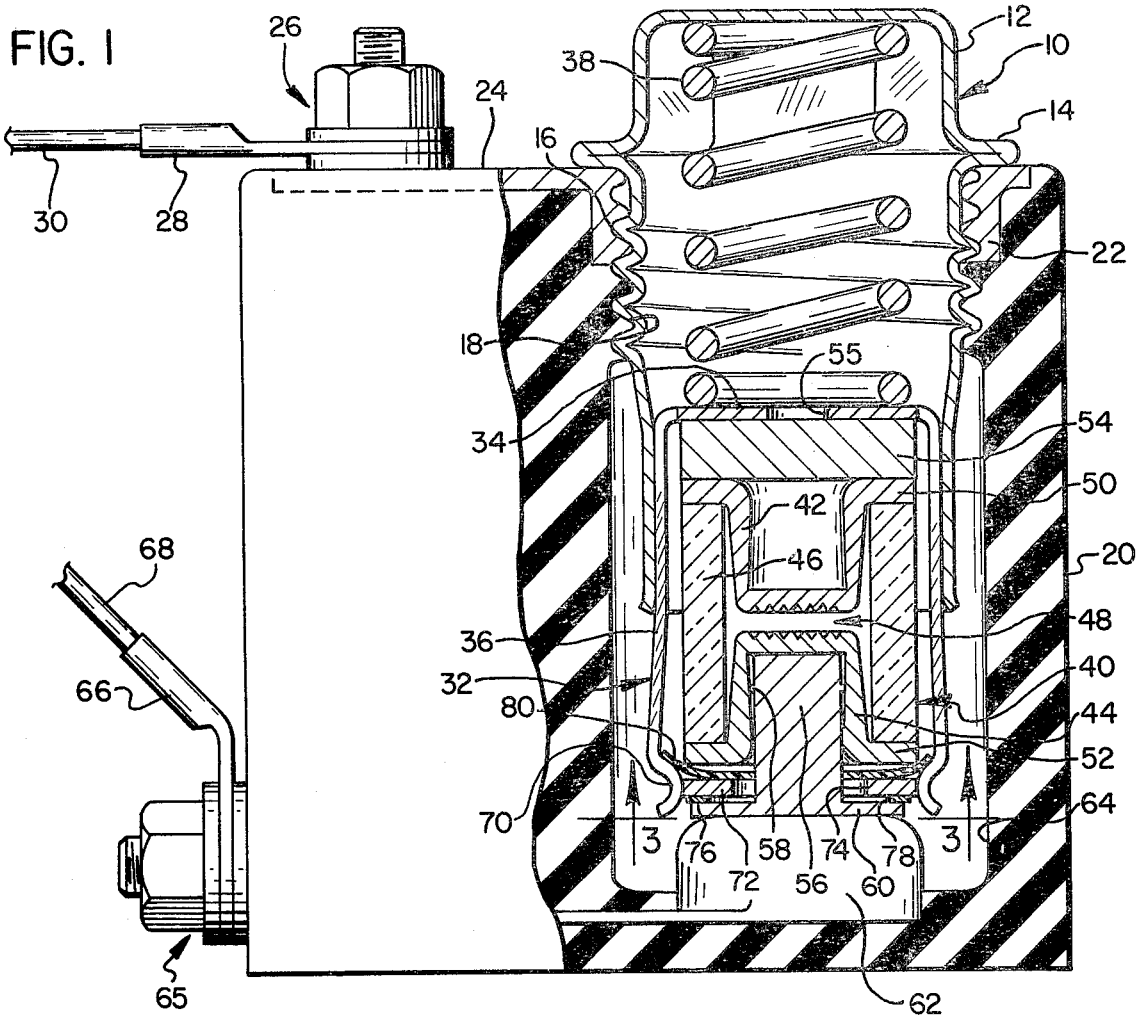
FIG. 1 is an end view, partially broken away in cross-section, of a spark gap protector according to the present invention.
Figure 3:
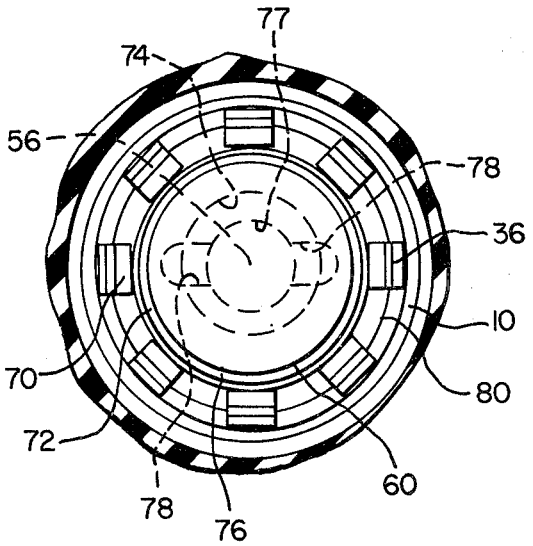
FIG. 3 is a transverse cross-section taken at 3—3 in FIG. 1.

Referring to the drawings and particularly FIGS. 1–4, a hollow cylindrical metal holder 10 includes a closed end cap portion 12 terminating at axial shoulder 14 and a threaded exterior configuration 16 for engaging internal thread 18 in insulating base member 20. The threaded exterior of holder 10 also engages a threaded conducting collar 22 against which shoulder 14 may be drawn up, the collar providing an external electrical connection via conducting plate 24 extending along, or molded to, the top of the base member 20 and terminating in a stud connection and nut 26 which secures a lug 28 to the base member. A wire 30, which may comprise a line which is being protected, is clamped to lug 28.

Within cylindrical holder 10 is received a cage 32 (See FIG. 4) comprising a first, disc-like, apertured end 34 and a plurality of spring fingers 36 which are bent to form an overall cylindrical configuration which is closely received within cylindrical metal holder 10. A spring 38 is interposed between the top of cap portion 12 and end 34 of cage 32 for urging the cage in a direction axially outwardly of holder 10.

Within cage 32 is located a hermetically sealed gas tube spark gap device 40 of the general kind described in U.S. Pat. No. 3,811,064 to Chester J. Kawiecki entitled SPARK GAP DEVICE, granted May 14, 1974, and assigned to the assignee of the present invention. The spark gap device 40 includes two cup-shaped end electrodes 42 and 44 having radial flanges 50 and 52 separated by an insulating spacer tube 46 so that the electrodes 42 and 44 form a spark gap 48 therebetween. The electrode flanges are sealed to the insulating spacer tube, with the interior of the envelope thus formed being provided with a gaseous environment at a given pressure for aiding in the establishment of conduction via gap 48 when a given voltage level is reached across the device. The outside surfaces of electrodes 42 and 44 respectively including flanges 50 and 52 also form first and second end terminals of the gas tube spark gap device.

Flange 50 of electrode 42 is spaced from first end 34 of cage 32 by a body of fusible material, suitably a solder pellet, 54. The opposite electrode 44 receives within its indented cup a cylindrical contact member 56 having a raised bead 58 around its upper periphery. The bead tends to hold the contact member within electrode 44 while assisting in making a connection between member 56 and electrode 44. Since the cup entrance is somewhat restricted, the contact member 56 may be snapped into place as slidably received within electrode 44. Contact member 56 further includes an enlarged axial flange or head 60 adapted to abut lower contact 62, centrally provided at the lower end of well 64 in the base member, under the pressure of spring 38. A stud and nut connection 65 secures lug 66 to the base member, this stud making connection with contact 62, internally of base member 20. A wire 68, joined to lug 66, is suitably connected to ground. Alternatively, wire 68 may comprise the protected line while wire 30 is grounded.

Fingers 36 of cage 32 are turned inwardly at their lower extremity at 70 forming convex surfaces to grasp metal conducting ring 72, the latter having an aperture 74 through which smaller diameter contact member 56 is coaxially received in spaced relation to the contact member. The ring 72 is disposed over the head 60 of member 56 but is insulated therefrom by insulating spacer ring 76 which is advantageously quite thin and suitably formed of a polyimide resin to insure against cold flow that might cause premature shorting of the unit. The insulating ring 76 is suitably 3 to 5 mils in thickness. More particularly, the material of the insulating ring may comprise Kapton "H" polyimide film. The insulating ring 76 has a central aperture 77 closely receiving the contact member 56, but wherein such aperture is extended on diametrically opposite sides by slots 78 which, in end to end measurement, total about eight-tenths of the diameter of insulating ring 76. Slots 78, in their narrow dimension, are suitably about half the diameter of aperture 77. This configuration provides close juxtaposition between flange 60 and conducting ring 72 across the spacing provided by ring 76 in the area of slots 78. An auxiliary spark gap in this area is thereby formed which supplies backup protection in the event of failure of the gas tube spark gap device 40. As is well known in the art, a low breakdown voltage of the gas tube device is accurately predetermined despite a gap spacing of approximately 30 mils. Such spacing enhances the operating life of the device and desired breakdown voltage is attained without requiring difficult constructional tolerances. However, in case the gas tube vents to the atmosphere, the breakdown voltage thereof may rise from a few hundred volts to several kilovolts. In the present construction, the breakdown voltage across insulating ring 76, in the case of a 3 mil thickness, is approximately 750 volts d.c., thereby providing suitable backup protection. Moreover, after one or more breakdowns across the auxiliary gap thus provided, the insulating ring 76 will become sufficiently carbonized to establish a short circuit or failsafe condition. In general, the breakdown voltage across ring 76 should be greater than that of the primary spark gap 48, but sufficiently low to protect adequately the associated electrical equipment.

Further referring to the drawings, an additional insulating disc 80 is provided between conducting ring 72 and lower flange 52 of spark gap electrode 44. Disc 80 may be formed of the same material as ring 76 and is suitably approximately 5 mils in thickness. The insulating disc 80 is bent upwardly around the lower portion of flange 52, separating indented portion 70 of fingers 36 from flange 52. The disc 80 includes a central aperture for closely receiving the contact member 56 therethrough. Disc 80 insulates electrode flange 52 from conducting ring 72 and fingers 36 of cage 32, and is sturdy enough to apply pressure to conducting ring 72 and insulating ring 76 to maintain the 3 mil spacing of the auxiliary spark gap.

Figure 5:
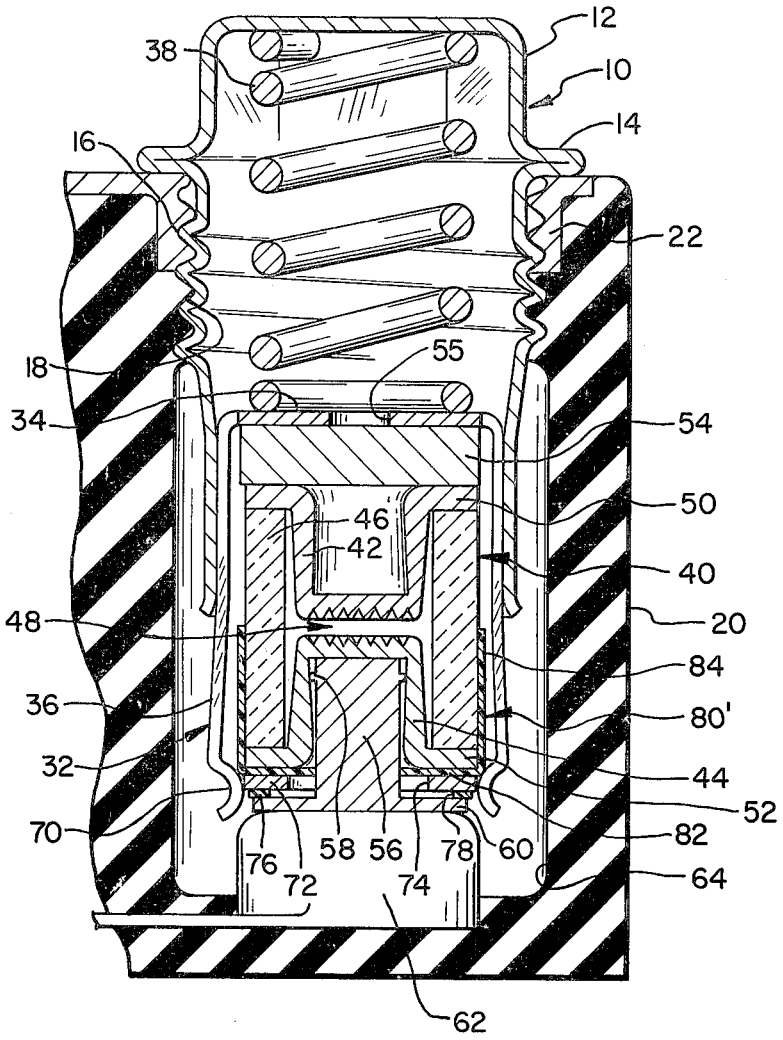
FIG. 5 is an end view, partially broken away and in cross-section, of a protector according to a second embodiment of the present invention.
Figure 4:
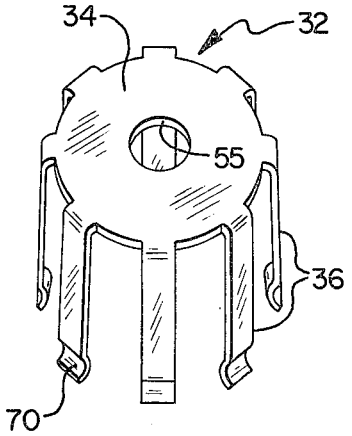
FIG. 4 is a perspective view of a shorting cage element employed in the FIG. 1 protector.
Figure 10:
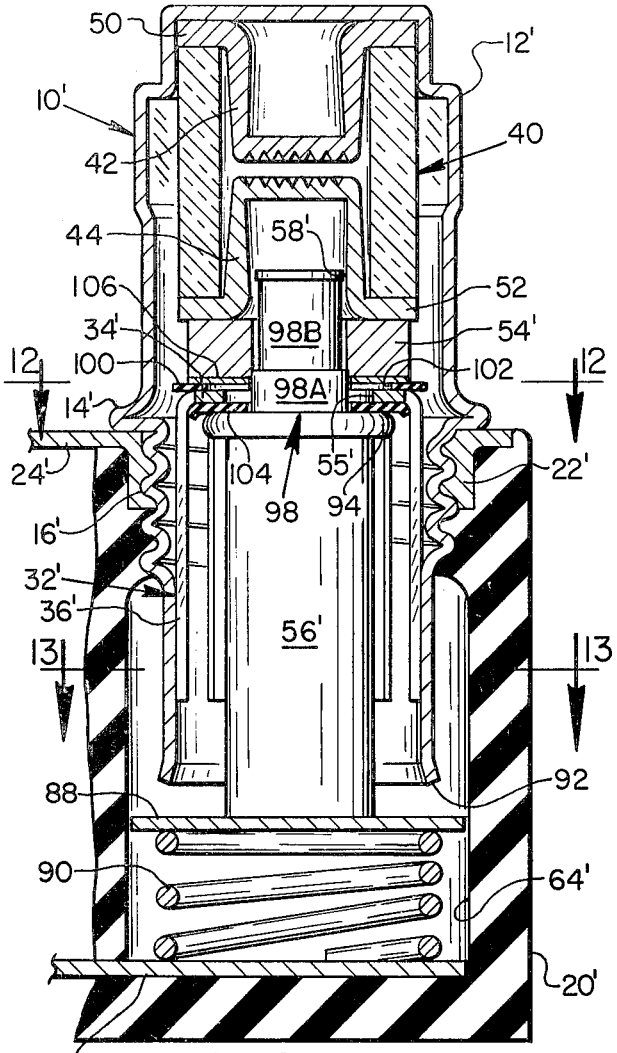
FIG. 10 is an end view, partially broken away and in cross-section, of a spark gap protector according to a fourth embodiment of the present invention.
Figure 11:
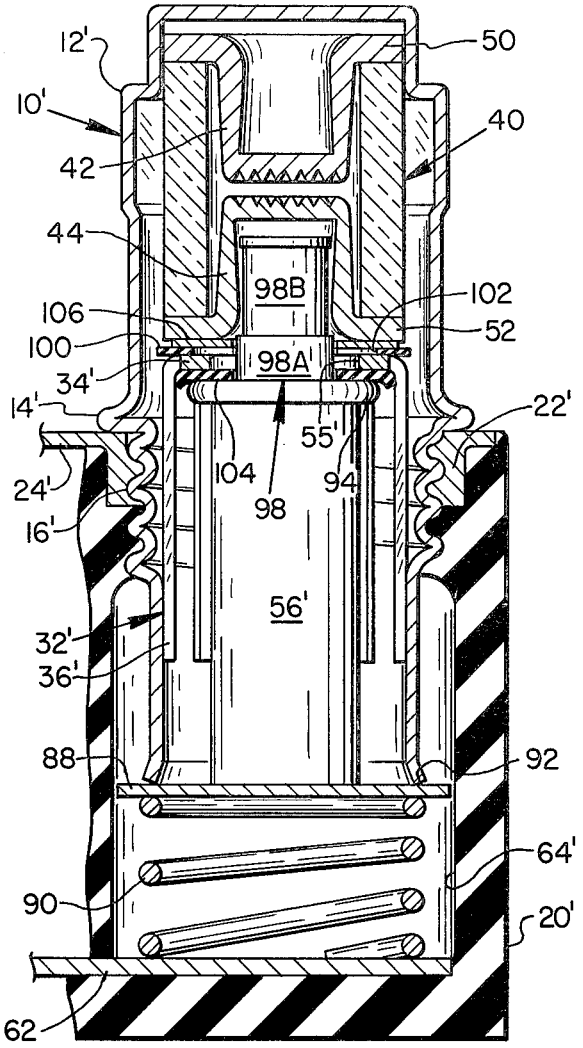
FIG. 11 is another end view, partially broken away in cross-section, of the same spark gap protector as illustrated in FIG. 10 and further showing the relationship of elements in the absence of the fusible metal body normally incorporated in the device.
Figure 12:
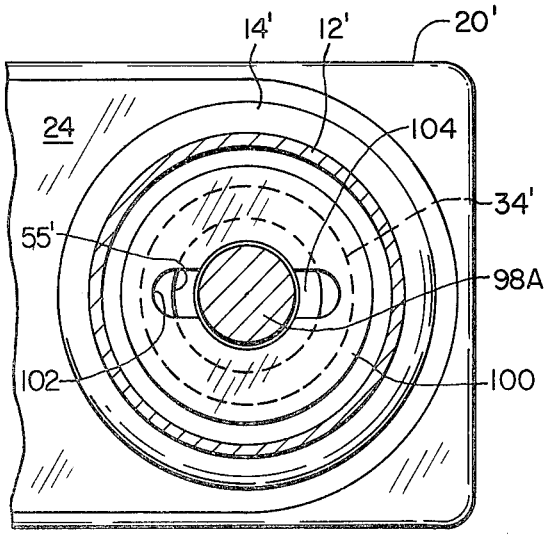
FIG. 12 is a transverse cross-section taken at 12—12 in FIG. 10.
Figure 13:
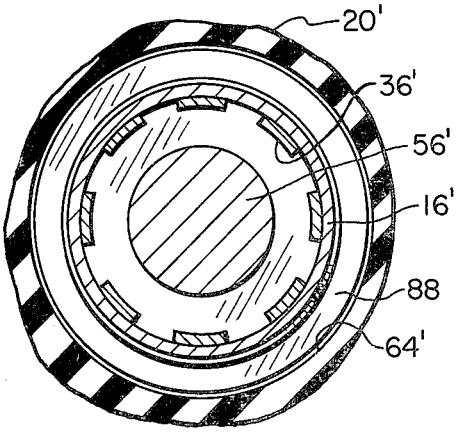
FIG. 13 is a transverse cross-section taken at 13—13 in FIG. 10.

An alternative embodiment of the present invention is illustrated in FIG. 5 wherein an insulating cap 80′ is substituted for the aforementioned disc 80. This cap 80′, which may be formed of Kapton, includes a disc portion 82 separating conducting ring 72 from flange 52, and a cylindrical portion 84 closely received up around about half the body of spark gap device 40. The disc portion 82 has a central aperture for closely receiving the contact member 56 therethrough. The FIG. 5 construction requires less care in assembling the complete protector, but is otherwise substantially identical in construction and operation to the device hereinbefore described.

Figure 2:
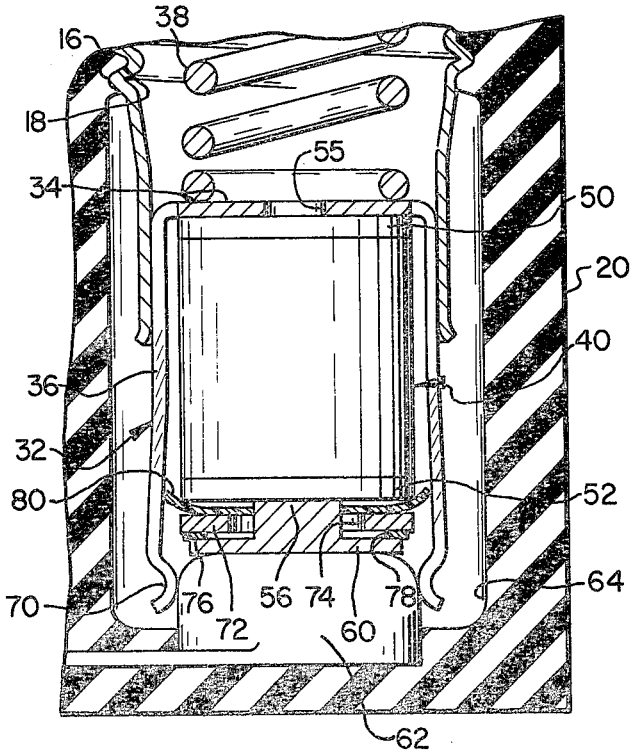
FIG. 2 is a second end view, partially broken away in cross-section, of a portion of the same spark gap protector showing the relationship of elements in the absence of the fusible metal body normally incorporated in the device.

According to normal operation for the embodiments of FIGS. 1 through 5, when a predetermined voltage level is reached across lines 30 and 68, the gap 48 breaks down into an arc discharge, thereby shorting out the high voltage to ground for protecting equipment on the line. The occurrence of a short duration discharge will not alter the operating characteristics of the spark gap device 40 and it will ordinarily remain operative. However, an arc discharge for an extended period of time, for example carrying long duration currents, will generate sufficient heat for melting solder pellet 54 whereby the spring pressure exerted by spring 38 will urge cage 32 downwardly causing fingers 36 and specifically the convex ends thereof to move downwardly for grasping and making connection with contact 62 as illustrated in FIG. 2. Under these conditions, the spark gap device and the protective circuit are shorted out, i.e., the system has failed safe shorting wire 30 to ground rather than relying upon the somewhat questionable protection afforded by a spark gap device which has conducted an excessive current.

FIG. 2, for example, illustrates the position of cage 32 relative to the other components as would result from melting of solder pellet 54 in FIG. 1. It is understood the fused solder pellet metal would ordinarily escape via aperture 55, as well as along the sides of the spark gap device 40, and this has been omitted from the drawing.

Should the spark gap device 40 become damaged as a result of surges insufficient to cause melting of solder pellet 54, or should the spark gap device otherwise become defective, the auxiliary spark gap provided across insulating spacer ring 76 will break down at a somewhat higher voltage, but still affording a considerable measure of protection to the equipment connected to line 30. With an extended discharge, the spacer 76 will tend to carbonize and failsafe.

A further embodiment of the present invention is illustrated in FIGS. 6 through 9 wherein the positions of spark gap device 40 and solder pellet 54 have been interchanged and the circuits for both the device 40 and auxiliary gap are completed through the solder pellet. It will be apparent that the failsafe feature in the embodiment of FIGS. 6 through 9 normally operates in a manner substantially similar to that hereinbefore described. Thus, an arc discharge for an extended period of time carrying long duration currents will generate sufficient heat for melting solder pellet 54 whereby the spring pressure exerted by spring 38 will urge cage 32 downwardly causing fingers 36 and specifically the convex ends thereof to move downwardly for grasping and making connection with a contact 62 as illustrated in FIG. 7. When the solder pellet melts, it will be seen the device 40 moves downwardly around the contact member 56 as illustrated in FIG. 7, with contact member portion 56B being of smaller diameter to permit this movement. Lower contact portion 56A is of slightly larger diameter for centering of the various elements therearound, including solder pellet 54, which is adapted to have a press fit with at least the upper shoulder of the lower contact member portion. Therefore, prior to melting, the solder pellet forms the main series connection between lower flange 52 of the spark gap device and contact 62 via contact member 56.

The auxiliary gap in the embodiment of FIGS. 6 through 9 is provided across an insulating ring 76′ disposed between conducting ring 72 and a conducting ring 86 abutting the lower side of solder pellet 54 as shown in greater detail in FIG. 9. The insulating ring 76′ is suitably formed of the same material as hereinbefore described for ring 76 with the thickness thereof suitably being between 3 and 5 mils. Ring 76′ also has a central aperture 77′ closely receiving contact member 56. Such aperture is extended on diametrically opposite sides by slots 78′ which, in end to end measurement, total about seven-tenths of the diameter of insulating ring 76′, while the narrow dimension of the slots is about half the diameter of aperture 77′. The insulating ring 76′ is thus substantially similar to the insulating ring 76 described with reference to the previous embodiments and provides thereacross an auxiliary spark gap for backup protection in the event of failure of the gas tube spark gap device 40. The breakdown voltage across insulating ring 76′, in the case of a 3 mil thickness, is approximately 750 volts d.c.

In case the gas tube spark gap device 40 becomes damaged, protection is thus still afforded across the auxiliary gap. In the embodiment of FIGS. 6 through 9, it will be observed the path of surge current through the auxiliary gap also includes solder pellet 54. Pellet 54, because of its series position in the circuit and because of its close proximity to the auxiliary gap, will be more likely to melt and provide a failsafe condition when the auxiliary gap breaks down than was the case in the first embodiment.

The construction of the embodiment of FIGS. 6 through 9 is completed by a disc 80′ which may be formed of the same material as ring 76′, and which is received between conducting ring 72 and head 60 of member 56. The disc 80′ is suitably approximately 5 mils in thickness, having a central aperture for closely receiving the contact member 56 therethrough. In the construction of FIGS. 6 through 9, the disc 72 is spaced from conducting ring 86 substantially only by the intermediate insulating ring 76′ so as to establish the auxiliary gap spacing at approximately the thickness of the insulating ring. If either ring 76′ or disc 80′ should conduct instead of device 40 because of moisture on the disc or ring, and should a high surge current flow thereacross, solder pellet 54 is likely to melt as a result of its close proximity to the short circuit path, thereby bringing about a failsafe condition.

A yet further embodiment of the present invention is illustrated in FIGS. 10 through 13, and is intended for use in situations where the diameter of well 64′ in the base member 20′ is somewhat limited. In this instance, hollow cylindrical metal holder 10′ includes a closed end cap portion 12′ terminating at an axial shoulder 14′, and a threaded exterior configuration 16′ for engaging internal threading in the insulating base member 20′. In the embodiment of FIGS. 10 through 13, the end cap portion 12′ is somewhat more vertically elongated than in the previous embodiments and receives therewithin the gas tube spark gap device 40 of the type hereinbefore described. Flange 50 of the spark gap device is positioned against the upper inside end of cap 12′ for making electrical contact therewith, while an elongated contact member 56′ and particularly upward extension 98 thereof, is received within cup-shaped electrode 44. In particular, a smaller diameter extension portion 98B carrying bead 58′ is received within electrode 44.

The lower end of electrode member 56′ abuts a circular conductive plate 88 biased upwardly by a conductive coil spring 38 positioned between plate 88 and a flat lower contact 62′ located at the lower end of well 64.

The spring 90 provides electrical connection between the exterior circuit and contact member 56', and urges the contact member upwardly for insuring electrical connection between flange 50 of the spark gap device and the upper wall of cap portion 12'.

Contact member 56' includes an intermediate shoulder 94 spaced below flange 52 of spark gap device 40 by solder pellet 54', a conducting metal ring 106, an insulating ring 100, end 34' of cage 36' and an insulating disc 104. Each of these members is centrally apertured to receive extension 98 of contact member 56' therethrough and particularly lower extension portion 98A. The solder pellet 54' abuts flange 52 of the spark gap device 40, while flat conducting ring 106, which may be formed in copper, separates the lower side of the solder pellet from insulating ring 100. The solder pellet 54' is adapted to have a press fit with at least the upper shoulder of lower extension portion 98A. Insulating ring 100 is suitably 3 to 5 mils in thickness and may be formed of the same material and may have the same general configuration as the insulating rings 76 and 76' in the previous embodiments. Thus, insulating ring 100 has a central aperture closely receiving the contact member extension 98 but such aperture is extended on diametrically opposite sides by slots 102 which have a narrow dimension suitably about half the diameter of the central aperture. The end-to-end measurement of the slots is about seven-tenths the diameter of insulating ring 100. This configuration provides close juxtaposition between conducting ring 106 and top end 34' of cage 32', the latter having a central aperture 55' larger than contact member extension 98 but appreciably smaller in diameter than the length of slots 102 whereby an auxiliary gap is provided at such juxtaposition between conducting ring 106 and cage end 34'.

Insulating disc 104, which is suitably formed from the same material as ring 100, separates cage end 34' from shoulder 94 of contact member 56', wherein the thickness of disc 104 is suitably approximately 5 mils. The cage 32' is closely received within the metal holder 10', but unlike the previous embodiments, has straight fingers 86' which are primarily employed for positioning of the cage and for making electrical contact with the metal holder 10'.

In operation, the device according to the embodiment of FIGS. 10 through 13 supplies the desired voltage surge protection through spark gap device 40 which normally shunts a high voltage surge to ground. An arc discharge for an extended period of time, for example carrying long duration currents, will generate sufficient heat for melting solder pellet 54' whereby the spring pressure exerted by spring 90 will urge plate 88 and contact member 56' upwardly, causing plate 88 to contact the lower skirt 92 of the holder 10'. Under these conditions, the spark gap device is shorted out, i.e., has failed safe.

However, should the spark gap device 40 become damaged as by venting caused by conduction insufficient to cause melting of solder pellet 54', or should the spark gap device otherwise become defective, the auxiliary spark gap provided across insulating spacer 100 will break down at a somewhat higher voltage, but still affording a considerable measure of protection to the equipment connected to the line. As in the just previous embodiment, solder pellet 54' is in series with the surge current path through both device 40 and the auxiliary gap whereby the pellet is likely to melt and provide a failsafe condition in the event of an extended discharge via either route. Also, in case moisture collects in the region of the auxiliary gap and should a high surge current flow thereacross, the close proximity of the solder pellet 54' makes failsafe action more likely.

While I have shown and described several embodiments of my invention, it will be apparent to those skilled in the art that many changes and modifications may be made without departing from my invention in its broader aspects. I therefore intend the appended claims to cover all such changes and modifications as fall within the true spirit and scope of my invention. I claim:

1. A spark gap protector comprising:

a gas tube spark gap device having at least a pair of conductive electrodes spaced apart by insulating means to provide a spark gap thereacross and having a hermatically sealed, predetermined gaseous environment in the region of said spark gap, shorting means activated by heat for electrically shorting said conductive electrodes under predetermined discharge conditions, and a substantially flat insulating spacer interposed between a pair of metal members in intimate contact therewith and normally interrupting the electrical short circuit path of said shorting means, said insulating spacer providing thereacross an auxiliary gap between said metal members adapted to break down into an arc discharge at a voltage less than the breakdown voltage of said gas tube spark gap device absent its gaseous environment.

2. The spark gap protector according to claim 1 wherein said insulating spacer includes a slot providing direct juxtaposition between said metal members.

3. A spark gap protector comprising:

a gas tube spark gap device having a pair of terminals and providing a spark gap therebetween, a cylindrical holder within which said spark gap device is received in substantially coaxial relation with respect to said holder, an axial contact member connected to one terminal of said spark gap device, the remaining terminal being connected to said holder, a base member receiving said holder, said base member being provided with means for matingly engaging the exterior of said holder in supporting relation, and for providing first and second electrical connections to said contact member and said holder, spring biased failsafe shorting means for shorting out said spark gap device, and a solder pellet adjacent said spark gap device for normally holding said spring biased shorting means out of electrical contact whereby heat from said spark gap device melts said solder pellet for allowing said shorting means to complete electrical contact under extended discharge conditions, and an auxiliary gap device comprising a thin substantially flat insulating ring coaxial with said contact member and separating a pair of substantially flat faced metal members bringing pressure on said insulating ring and connected respectively to said contact member and said holder, the length of said auxiliary gap being equal to the thickness of said insulating ring.

4. The protector according to claim 3 including a spring disposed in axial arrangement with said gas tube spark gap device and said solder pellet for spring biasing said failsafe shorting means and said pair of substantially flat metal members.

5. The protector according to claim 3 including a slot in said insulating ring providing direct juxtaposition between said metal members.

6. A spark gap protector comprising:

a gas tube spark gap device having a pair of terminals and providing a spark gap therebetween, a cylindrical holder within which said spark gap device is received in substantially coaxial relation with respect to said holder, an axial contact member connected to one terminal of said spark gap device, the remaining terminal being connected to said holder, a base member receiving said holder, said base member being provided with means for matingly engaging the exterior of said holder in supporting relation, and for providing first and second electrical connections to said contact member and said holder, spring biased failsafe shorting means for shorting out said spark gap device, and a solder pellet adjacent said spark gap device for normally holding said spring biased shorting means out of electrical contact whereby heat from said spark gap device melts said solder pellet for allowing said shorting means to complete electrical contact under extended discharge conditions, and an auxiliary gap device comprising a thin insulating ring coaxial with said contact member and separating a pair of metal members connected respectively to said contact member and said holder, the length of said auxiliary gap being equal to thickness of said insulating ring, wherein said spring biased failsafe shorting means comprises a cage received within said holder and receiving said spark gap device and adjacent solder pellet therewithin, said cage having spring fingers adapted to reach beyond the combined length of said spark gap device and solder pellet, wherein said spring fingers grasp a said metal member in the form of a conducting ring disposed in surrounding spaced relation to said contact member, said fingers connecting said conducting ring to said holder so long as said solder pellet remains unmelted, and further including a spring for biasing said cage toward an electrical connection in said base member for shorting out said spark gap device upon melting of said solder pellet.

7. The protector according to claim 6 wherein a second metal member comprises a radial flange of said axial contact member separated from said conducting ring by said thin insulating ring.

8. The protector according to claim 6 wherein the second of said metal members comprises a second conducting ring in coaxial relation with said contact member and located between the first-mentioned conducting ring and the combination of said spark gap device and said solder pellet.

9. The protector according to claim 6 wherein said solder pellet is received in a first end of said cage remote from the ends of said spring fingers, said solder pellet being positioned between said first end of said cage and said spark gap device.

10. The protector according to claim 6 wherein said spark gap device is received at the end of said cage remote from the ends of said spring fingers while said solder pellet is received in said cage between said spark gap device and said auxiliary gap device, said solder pellet being annular and receiving said axial contact member therethrough, wherein said contact member extends into an end cup of an electrode comprising said one terminal of said spark gap device for a short distance adapting said spark gap device to move with said cage toward an electrical connection in said base member upon melting of said solder pellet.

11. A spark gap protector comprising:

a gas tube spark gap device having a pair of terminals and providing a spark gap therebetween, a cylindrical holder within which said spark gap device is received in substantially coaxial relation with respect to said holder, an axial contact member connected to one terminal of said spark gap device, the remaining terminal being connected to said holder, a base member receiving said holder, said base member being provided with means for matingly engaging the exterior of said holder in supporting relation, and for providing first and second electrical connections to said contact member and said holder, spring biased failsafe shorting means for shorting out said spark gap device, and a solder pellet adjacent said spark gap device for normally holding said spring biased shorting means out of electrical contact whereby heat from said spark gap device melts said solder pellet for allowing said shorting means to complete electrical contact under extended discharge conditions, said failsafe shorting means including a spring biased plate normally making contact with said axial contact member and connecting the same to an electrical connection in said base member, and wherein said spring biased plate moves into contact with said cylindrical holder upon melting of said solder pellet, and an auxiliary gap device comprising a thin insulating ring coaxial with said contact member and separating a pair of metal members connected respectively to said contact member and said holder, the length of said auxiliary gap being equal to the thickness of said insulating ring, where a said metal member comprises an end of a cage received in slidable relation within said cylindrical holder, the remaining metal member comprising an annular conducting ring coaxial with said contact member and positioned adjacent said solder pellet, said spark gap device being received within said holder but above said cage.

12. The protector according to claim 11 wherein said solder pellet is annular and is received adjacent said spark gap device in coaxial surrounding relation to said contact member, said contact member extending into a cup shaped electrode comprising said one terminal of said spark gap device by a short distance allowing further movement thereof upon melting of said solder pellet such that said contact member permits said spring biased plate to move into contact with said cylindrical holder.

13. A spark gap protector comprising:

a gas tube spark gap device having at least two conductive electrodes spaced apart by an insulating cylinder to provide a first spark gap thereacross and having a hermetically sealed, predetermined internal gaseous environment in the region of said first spark gap, said first spark gap having a first relatively low breakdown voltage in the presence of said predetermined internal gaseous environment and a second relatively high breakdown voltage in the absence of said predetermined internal gaseous environment, a base member including a well for receiving an assembly including said spark gap device and a holder for said gas tube spark gap device, a failsafe shorting means disposed in cooperative relation with said assembly in said base member and responsive to flow of electrical current of predetermined magnitude and duration through said spark gap device for electrically short circuiting the conductive electrodes of said spark gap device, and means physically distinct from said shorting means for providing a second spark gap electrically in parallel with said first spark gap within said base member, said second spark gap having a third breakdown voltage intermediate said first and second breakdown voltages, wherein said means providing said second spark gap comprises a substantially flat insulating spacer interposed between a pair of metal members which are in flat contact with said spacer and which are electrically disposed in a series electrical path between said conductive electrodes, said insulating spacer providing thereacross said second spark gap between said metal members, the length of said second spark gap being equal to the thickness of said insulating spacer.

14. A spark gap protector comprising:

a gas tube spark gap device having at least two conductive electrodes spaced apart by an insulating cylinder to provide a first spark gap thereacross and having a hermetically sealed, predetermined internal gaseous environment in the region of said first spark gap, said first spark gap having a first relatively low breakdown voltage in the presence of said predetermined internal gaseous environment and a second relatively high breakdown voltage in the absence of said predetermined internal gaseous environment, means responsive to the flow of electrical current of a predetermined magnitude and duration for electrically short circuiting said conductive electrodes, means for housing and physically supporting said spark gap device and said short circuiting means, said housing and supporting means comprising a cylindrical holder within which said spark gap device is received, and a base member receiving said holder, said base member being provided with means for matingly engaging the exterior of said holder in supporting relation and for providing first and second electrical connections for said spark gap device and said short circuiting means, and means physically distinct from said short circuiting means for providing a second spark gap electrically in parallel with said first spark gap, said second spark gap having the third breakdown voltage intermediate said first and second breakdown voltages, said second spark gap providing means comprising a pair of conducting discs substantially coaxial with said gas tube spark gap device and holder within said base member and disposed in a series electrical path between said first and second electrical connections, and an insulating spacer disc separating said conducting discs for defining said second spark gap thereacross, the length of said second spark gap being equal to the thickness of said insulating spacer disc, said conducting discs being urged toward said spacer disc therebetween to maintain the gap spacing of said second spark gap.

15. A method of protecting relatively low voltage electrical equipment from damage or destruction due to overvoltage surges, comprising the steps of, disposing a gas tube spark gap device having at least two conductive electrodes spaced apart by an insulating cylinder to provide a first spark gap therebetween and having a hermetically sealed, predetermined, internal gaseous environment in the region of said first spark gap, said spark gap exhibiting a first, relatively low, breakdown voltage in the presence of said predetermined, internal, gaseous environment, and a second, relatively high breakdown voltage in the absence of said predetermined, internal, gaseous environment, in an operative relationship with respect to said equipment such that overvoltage surges of a predetermined magnitude are shunted through said gas tube spark gap device rather than passing through said electrical equipment, disposing means responsive to the flow of electrical current across said first spark gap of a predetermined magnitude and duration for electrically short circuiting said conductive electrodes in an operative relationship with respect to said first spark gap, disposing in an electrical parallel relationship with respect to said first spark gap, means, physically distinct from said short circuit means, for providing a second spark gap electrically in parallel with said first spark gap and exhibiting a third breakdown voltage intermediate said first and second breakdown voltages, including electrically disposing a pair of conducting discs with an insulating spacer disc therebetween in an electrical series path between said conductive electrodes to define said second spark gap thereacross, including urging said conducting discs toward one another to maintain the spacing of said second spark gap, and housing said gas tube spark gap device, said short circuiting means and said second spark gap providing means in an insulating base member having electrically conductive means for electrically connecting said conductive electrodes to said electrical equipment.

16. A spark gap protector comprising:

a pair of terminals for connection in circuit with equipment to be protected, a gas tube spark gap device having at least a pair of conductive electrodes spaced apart by insulating means to provide a spark gap thereacross and having a hermetically sealed, predetermined gaseous environment in the region of said spark gap, shorting means activated by heat for electrically shorting said conductive electrodes under predetermined discharge conditions, said shorting means including spring biased contact means coupled in shunt relation with said gas tube spark gap device between said terminals, and a solder pellet adjacent said spark gap device for normally holding the spring biased contact means out of electrical contact, and an insulating spacer disc normally interrupting the electrical short circuit path of said shorting means and under spring pressure from said shorting means, said insulating spacer disc providing thereacross an auxiliary gap adapted to break down into an arc discharge at a voltage less than the breakdown voltage of said gas tube spark gap device absent its gaseous environment, said solder pellet being positioned between said gas tube spark gap device and said insulating spacer in series electrical relation with both said gas tube spark gap device and said auxiliary gap between said terminals so that current through either said gas tube spark gap device or said auxiliary gap flows through said solder pellet.

* * * * *

UNITED STATES PATENT AND TRADEMARK OFFICE

CERTIFICATE OF CORRECTION

PATENT NO. : 4,132,915

DATED : January 2, 1979

INVENTOR(S) : MANFRED W. WILMS

It is certified that error appears in the above-identified patent and that said Letters Patent are hereby corrected as shown below:

On the Title Page, line 13, under Abstract, "provided" should be --provides--.

Col. 2, line 4, after "event" and before "partial" insert --of--.

Col. 9, line 34, before "thickness" insert --the--.

Col. 10, line 45, "where" should be --wherein--.

Signed and Sealed this

*Third* Day of *November 1981*

[SEAL]

*Attest:*

GERALD J. MOSSINGHOFF

*Attesting Officer* *Commissioner of Patents and Trademarks*